United States Patent [19]

Hollier

[11] Patent Number: 4,906,322

[45] Date of Patent: Mar. 6, 1990

[54] MASKING PAPER AND MASKING TAPE DISPENSER

[76] Inventor: Joseph H. Hollier, Rte. 2, Box 518, Pearcy, Ark. 71964

[21] Appl. No.: 312,939

[22] Filed: Feb. 21, 1989

[51] Int. Cl.[4] ..... B26F 3/02; B32B 35/00

[52] U.S. Cl. ..... 156/527; 156/544; 156/554; 156/577; 156/579; 225/79

[58] Field of Search ..... 156/523, 527, 574, 577, 156/579, 544, 554; 225/51, 79; 221/70

[56] References Cited

U.S. PATENT DOCUMENTS

| | | | |
|---|---|---|---|
| 3,950,214 | 4/1976 | Pool et al. | 156/554 |
| 4,425,182 | 1/1984 | Jones et al. | 156/527 |
| 4,508,587 | 4/1985 | Hunter | 156/554 |
| 4,667,891 | 5/1987 | Pool | 156/527 |

*Primary Examiner*—Michael Wityshyn
*Attorney, Agent, or Firm*—George F. Helfrich

[57] ABSTRACT

A device 11 is provided for simultaneously dispensing masking paper 12 from a roll 13 and masking tape 14 from a roll 15 so that masking tape 14 is affixed to masking paper 12 in a position which is partially on and partially off a longitudinal edge 16 of masking paper 12. The device includes a main frame 17, which has a central arcuate section 18 that overlies and partially envelops masking paper roll 13, being substantially concentric therewith. The main frame 17 has a forward section 19, which is adapted to receive and secure tearing means 20 for severing a desired segment of the masking paper with affixed masking tape. Main frame 17 has a rearward section 21 forming a handle 22, which is located at substantially the same level and to the rear of arcuate section 18, between the masking paper roll 13 and the masking tape roll 15. A secondary frame 23 is positioned and attached under main frame 17 and is adapted for rotational mounting of both the roll of masking paper 13 and the roll of masking tape 15, the latter being spaced from the roll of masking paper 13 and located to the rear thereof in proximity to handle 22.

3 Claims, 1 Drawing Sheet

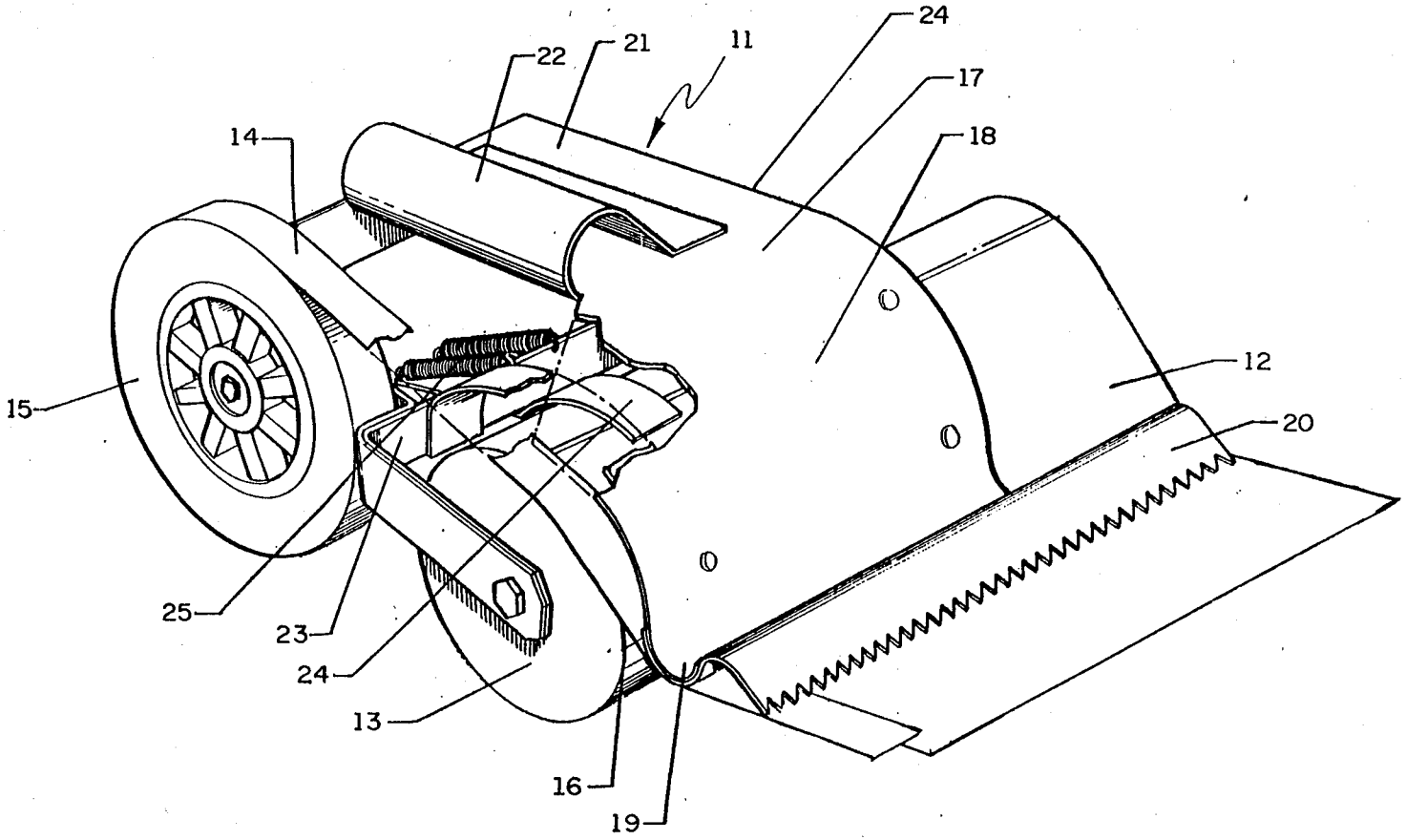
11
12
13
14
15
16
17
18
19
20
21
22
23
24
24
25

MASKING PAPER AND MASKING TAPE DISPENSER

BACKGROUND OF THE INVENTION

1. Field of the Invention

The present invention relates generally to hand-held masking machines. It relates particularly to hand-held masking machines which simultaneously dispense masking paper and masking tape, so that the masking paper is dispensed with a border of masking tape extending over a longitudinal edge thereof, whereby the paper is readily applicable to a surface being masked.

2. Description of Related Art

A large number of devices are known and used for applying masking paper and masking tape to a surface in order to prepare it for painting, trimming, finishing, and other related techniques. It is common to dispense the masking paper and the masking tape simultaneously, with the tape extending over a longitudinal edge of the paper, so that the paper is readily applicable to a surface being masked. Examples of these devices are disclosed in the following patents: U.S. Pat. No. 4,508,587; U.S. Pat. No. 4,379,019; and U.S. Pat. No. 4,096,021. Notwithstanding the efficacy of these and similar devices, they are found wanting in that the dispensing and applying of paper/tape therefrom involves a pushing and/or twisting motion by the hand of the operator, which is applied to a handle located at a position substantially above the level of the paper and tape rolls. This results in a reduced efficiency of application, as well as operator fatigue.

SUMMARY OF THE INVENTION

It is accordingly the primary object of the present invention to provide what is not available in the prior art, viz., a device for the simultaneous dispensing of masking paper and masking tape, the use of which involves more of a pulling, rather than a pushing/twisting motion, as paper/tape is removed and applied, resulting in enhanced efficiency and reduced operator fatigue This and other objects and benefits are achieved by the provision of a device which includes a main frame having a central arcuate section overlying and partially enveloping a roll of masking paper and being substantially concentric therewith, the main frame having a forward section including a tearing means for severing a desired segment of masking paper with affixed masking tape from rolls thereof. The main frame has a rearward section forming an integral handle located at substantially the same level and to the rear of the arcuate section, between a masking paper roll and a masking tape roll. The device also includes a secondary frame positioned under the main frame and attached thereto. The secondary frame is adapted for rotational mounting of both the roll of masking paper and the roll of masking tape, the roll of masking paper being rotatively mounted under the central arcuate section, and the roll of masking tape being rotationally mounted so that it is spaced from the roll of masking paper and is located to the rear thereof, in proximity to the handle.

It is of especial advantage that the main frame of the device is fashioned from a single sheet of construction material.

Especially good results are obtained when the tearing means is a blade which is detachably mounted to the forward section of the main frame, and when the device additionally comprises a drag means attached to the secondary frame for applying pressure to the outer surface of the roll of masking paper to prevent undesired unwinding of paper during dispensing and application.

BRIEF DESCRIPTION OF THE DRAWING

For a more complete understanding of the present invention, including its primary object and attending benefits, reference should be made to the Description of the Preferred Embodiments, which is set forth below. This Description should be read together with the accompanying drawing, wherein:

The single drawing figure is a perspective view of a preferred embodiment of the present invention which is ready for the simultaneous dispensing and application of masking paper and masking tape.

DESCRIPTION OF THE PREFERRED EMBODIMENTS

Referring now to the drawing, there is shown a device 11 according to a preferred embodiment of the present invention. Device 11 will simultaneously dispense standard masking paper 12 from roll 13 and standard masking tape 14 from roll 15 so that masking tape 14 is affixed to masking paper 12 in a position so that a border of masking tape 14 extends over a longitudinal edge 16 of masking paper 12. Masking paper 12 is thereby readily applicable to a desired surface being masked, and such a masking operation takes place simply and in one continuous operation. Device 11 includes main frame 17, which is fabricated from a standard construction material such as aluminum, steel, etc. It is especially advantageous if main frame 17 is fashioned from a single sheet of the construction material without any welding and without the presence of double-curved surfaces, as is understood by those of skill in the art. A minimal amount of construction material is thereby employed, and maximum strength and durability result from this simple, lightweight construction.

Main frame 17 has a central, arcuate section 18 which overlies and partially envelops masking paper roll 13, section 18 and masking paper roll 13 are substantially concentric. Main frame 17 has a forward section 19 which includes a tearing means for severing a desired segment of masking paper 12 with affixed masking tape 14 from rolls 13 and 15, respectively, which are discussed in more detail below. The tearing means may be merely the forward end of main frame 17 which is fashioned as a sharp, straight edge, or it may be a separate blade 20, as shown in the drawing, which is detachably mounted to the forward section of main frame 17. Main frame 17 also includes rearward section 21, having an integral handle 22 formed therein. Handle 22 is located at substantially the same level as arcuate section 18 and to the rear thereof. In prior art devices, the handles of hand-operated maskers are located substantially above the rolls of masking tape and masking paper, thereby requiring a twisting motion during application. This causes early fatigue in the operator, as such a twisting motion results in extra stresses on the wrist. However, with the instant invention such is not the case. Herein the handle is just slightly above the level of the rolls of masking tape and masking paper, and to the rear of the roll of masking paper. Such a positioning results in a smooth, pulling motion during application, which is controlled much more easily, and which does not result in early fatigue in the operator.

Device 11 also includes secondary frame 23, which is fabricated from a standard material of construction and is positioned underneath main frame 17, where it is attached thereto by standard attaching means. Secondary frame 23 is adapted for standard rotational mounting of masking paper roll 13 and masking tape roll 15 as shown. These two rolls are spaced from each other with masking tape roll 15 being located to the rear of masking paper roll 13, which is mounted under arcuate section 18.

Masking tape roll 15 is located slightly under and in proximity to handle 22. Drag means such as curved lever 24, which is attached to secondary frame 23 and pressed against the outer surface of masking paper roll 13 by means of springs 25, applies pressure to the outer surface of masking paper roll 13 so that undesired winding of paper therefrom is prevented during the application process.

The present invention has been described in detail with respect to certain preferred embodiments thereof. However, it is apparent to those of skill in the art that variations and modifications in this detail may be made without any departure from the spirit and scope of the present invention as defined in the hereto-appended claims.

What is claimed is:

1. A device for simultaneously dispensing masking paper from a roll thereof and masking tape from a roll thereof so that said masking tape is affixed to said masking paper in a position partially on and partially off a longitudinal edge of said masking paper, the device comprising:

a main frame formed solely from a sheet of flat construction material and having a central arcuate section overlying and partially enveloping the roll of masking paper and being substantially concentric therewith, the main frame having a forward section including a tearing means for severing a desired segment of masking paper with affixed masking tape from the rolls thereof, the main frame having a rearward section forming a handle located at substantially the same level and to the rear of the arcuate section, between the masking paper roll and the masking tape roll; and a secondary frame positioned under the main frame and attached thereto, the secondary frame being adapted for rotational mounting of both the roll of masking paper and the roll of masking tape, the roll of masking paper being rotationally mounted under the central arcuate section, and the roll of masking tape being rotationally mounted so that it is spaced from the roll of masking paper and is located to the rear thereof in proximity to the handle.

2. The device of claim 1, wherein the tearing means is a blade which is detachably mounted to the forward section of the main frame.

3. The device of claim 1, which additionally comprises a drag means attached to the secondary frame for applying pressure to the outer surface of the roll of masking paper to prevent undesired unwinding of masking paper from the roll thereof

* * * * *